US008555760B2

(12) United States Patent
Heidlmayer et al.

(10) Patent No.: US 8,555,760 B2
(45) Date of Patent: Oct. 15, 2013

(54) APPARATUS FOR DETACHING A WORKPIECE FROM A CUTTING TABLE

(75) Inventors: Franz Heidlmayer, St. Marien (AT); Rudolf Ahrer, Losenstein (AT); Harald Dietachmayr, Sierning (AT)

(73) Assignee: GFM-GmbH, Steyr (AT)

( * ) Notice: Subject to any disclaimer, the term of this patent is extended or adjusted under 35 U.S.C. 154(b) by 943 days.

(21) Appl. No.: 12/386,164

(22) Filed: Apr. 14, 2009

(65) Prior Publication Data

US 2009/0260497 A1 Oct. 22, 2009

(30) Foreign Application Priority Data

Apr. 21, 2008 (AT) ..... A 627/2008

(51) Int. Cl.
*B26D 7/18* (2006.01)

(52) U.S. Cl.
USPC ..... 83/151; 83/167

(58) Field of Classification Search
USPC ..... 83/157, 151–152, 78, 23, 112, 155.1, 83/161, 162, 163, 165; 271/33, 112, 271/10.07, 900, 310–312, 184–185; 198/364, 369.2, 369.6, 457.03
See application file for complete search history.

(56) References Cited

U.S. PATENT DOCUMENTS

| | | | | |
|---|---|---|---|---|
| 1,148,509 | A * | 8/1915 | Gammeter | 271/311 |
| 2,351,367 | A * | 6/1944 | Rider | 271/33 |
| 3,095,193 | A | 6/1963 | Sorenson | |
| 3,625,507 | A * | 12/1971 | Lucius | 271/33 |
| 3,961,784 | A * | 6/1976 | Sevak et al. | 271/94 |
| 4,143,871 | A | 3/1979 | Blessing | |
| 5,087,315 | A | 2/1992 | King et al. | |
| 5,228,554 | A * | 7/1993 | Kuchta et al. | 198/635 |
| 5,427,368 | A * | 6/1995 | Abe et al. | 271/283 |

FOREIGN PATENT DOCUMENTS

| | | |
|---|---|---|
| AT | 001 377 | 4/1997 |
| DE | 26 22 781 | 12/1977 |
| DE | 27 29 605 | 1/1978 |
| DE | 103 24 689 | 12/2004 |
| GB | 2 183 609 | 6/1987 |

* cited by examiner

*Primary Examiner* — Laura M Lee
(74) *Attorney, Agent, or Firm* — Collard & Roe, P.C.

(57) ABSTRACT

An apparatus is for detaching a workpiece from a cutting table. The workpiece is a cutting cut out from a flexible web made of fiber material. A raising device is displaceable relative to the cutting table receiving the web with the cutting and has a run-up surface for the workpiece ascending from the cutting table for progressively lifting the workpiece from the cutting table. A receiving device progressively receives the workpiece after the run-up surface. A lifting device is provided at a distance above the cutting table and includes a receiver which can be adjusted to the length of the boundary section of the cutting facing the raising device and which holds the received boundary section in a transfer position lifted off from the cutting table. The raising device is displaceable between the lifting device and the web resting on the cutting table.

15 Claims, 9 Drawing Sheets

APPARATUS FOR DETACHING A WORKPIECE FROM A CUTTING TABLE

CROSS REFERENCE TO RELATED APPLICATIONS

Applicant claims priority under 35 U.S.C. §119 of Austrian Application No. A 627/2008 filed on Apr. 21, 2008.

FIELD OF THE INVENTION

The invention relates to an apparatus for detaching a workpiece from a cutting table, which workpiece comprises a cutting cut out from a flexible web made of fiber material, comprising a raising device which is displaceable relative to the cutting table receiving the web with the cutting and which comprises a run-up surface for the workpiece rising from the cutting table for progressively lifting the workpiece from the cutting table, a receiving device progressively receiving the workpiece after the run-up surface and a lifting device for the edge of the workpiece facing the raising device.

DESCRIPTION OF THE PRIOR ART

If it is not possible to lift off cuttings cut out from a flexible web with the help of lifting devices that use negative pressure from the web because said cuttings are air-permeable, as is generally the case with webs made of fiber material, such cuttings can be grasped in a mechanical way. It is known for this purpose (U.S. Pat. No. 5,087,315 A) to press a flexible base plate which is adjusted to the shape of the respective cutting against the respective cutting, which base plate is associated with gripper rolls with gripper needles on mutually opposite sides of the cutting for gripping the boundary sections of the cuttings which protrude beyond the receiving plate, so that during a respective rotation of the gripper rolls the gripper needles will penetrate the boundary sections and subject the cutting to a tensile stress which will ensure contact of the cutting on the cylindrically curved bottom side of the receiving plate during the forward bulging of the receiving plate against the cutting table receiving the web which occurs during the lifting. The disadvantageous aspect is however the tensile stress that needs to be applied mandatorily and the likelihood of damage to the cuttings caused by the gripping needles in the boundary sections.

In order to enable a precisely positioned detachment of the cuttings from a cutting table, it has already been proposed (DE 103 24 689 A1) to lift off the cuttings together with the remaining web via a raising device in a progressive manner from the cutting table and to transfer the lifted section to a receiving device adjacent to the raising device for the workpiece which is formed by the cuttings and the remaining web. The raising device, which can be displaced for this purpose relative to the cutting table, comprises a run-up surface for the workpiece rising from the cutting table, which surface is formed by fingers arranged in the manner of a rake which engage in lanes of the cutting table, so that when moving underneath the workpiece with this raising device the workpiece piece is lifted off along the run-up surface from the cutting table and slides upon the receiving device which is arranged as a conveyor belt for example. Sliding movements between the conveyor belt and the workpiece can be avoided by a respective choice of the revolving speed of the conveyor belt which is adjusted to the advancing motion of the lifting device relative to the cutting table. In order to ensure that stresses caused by frictional forces on the workpiece made from a fiber material can be excluded which occur during the lifting of the workpiece along the run-up surface of the raising device, the fingers forming such run-up surfaces can also be equipped with revolving conveyor belts. Moving beneath the workpiece with the raising device can additionally be supported by a lifting device associated with the cutting table, which lifting device lifts the workpiece at least in the region of the edge of the workpiece facing the lifting device, which occurs with respectively distributed lifting devices. These lifting devices can comprise lifting pins penetrating the cutting table which forms lanes for receiving the fingers of the raising device forming the run-up surface, but can also consist of compressed-air nozzles which produce an air cushion lifting off the boundary section of the workpiece from the cutting table in order to support the raising device from gripping beneath the workpiece. The disadvantageous aspect is however that no severing of the cutting from the remaining web is possible.

It is finally known (AT 001 377 U1), for the aligned depositing of flexible workpieces such as leather on a cutting table, to provide an aligning table upstream of a cutting table and to deposit the workpiece aligned on the aligning table in a correct position on the cutting table. The aligning table comprises for this purpose a pallet which is displaceable between the aligning table and the cutting table and which is enclosed by a conveyor belt revolving in the direction of travel of the pallet. In the transitional region between the aligning table and the cutting table, a lock for the strand of the conveyor belt receiving the workpiece is provided, so that after the displacement of the pallet from the aligning table to the cutting table during the return of the pallet the strand of the conveyor belt with the workpiece can be held in a stationary manner relative to the cutting table with the effect that the workpiece is deposited in a progressive manner on the cutting table according to the restoring movement of the pallet, which occurs without any relative movement between conveyor belt and workpiece. Although this known apparatus can place workpieces in a predetermined correct position on a cutting table, it is unable to detach workpieces from a cutting table by severing the cuttings from the remaining web.

SUMMARY OF THE INVENTION

The invention is thus based on the object of providing an apparatus for detaching a workpiece by a cutting table of the kind mentioned above in such a way that cuttings cut from a web can be detached separately from the remaining web by a cutting table without having to fear any overloading of the cuttings.

This object is achieved by the invention in such a way that the lifting device which is provided at a distance above the cutting table comprises a receiver which can be adjusted to the length of the boundary section of the cutting facing the raising device and holds the received boundary section of the cutting in a transfer position lifted off from the cutting table and the raising device is displaceable between the lifting device and the web resting on the cutting table.

By providing a lifting device which is arranged at a distance above the cutting table and a receiver for said boundary section which can be adjusted to the length of the boundary section of the cutting facing the raising device, the space between the cutting lifted off from the cutting table and the web remaining on the cutting table remains free for unobstructed movement beneath the raised cutting by the raising device, which is guided above the web remaining on the cutting table, so that only the cutting lifted at first only on the edge side from the remaining web is gripped by the raising device and is lifted off progressively by transfer to the adjacent receiving device from the remaining web remaining on the cutting table.

The receiving device for the cutting adjacent to the raising device can be arranged in different ways. One possibility is that the receiving device forms a support which is stationary during the transfer of the cutting relative to the cutting table and comprises a receiving surface parallel to the table for the cutting on the bottom side facing the cutting table, and that the lifting device comprises a tape which is deflected about the end of the raising device facing the cutting to be lifted and is guided along the run-up surface rising up to the receiving surface on the bottom side of the support, which tape is held in a stationary manner relative to the support with its strand running off the run-up surface and clamps the cutting between itself and the receiving surface of the support. The cutting which is lifted off from the cutting table by the raising device is pressed as a result of this measure by means of the run-up surface against the receiving surface on the bottom side of the support of the receiving device, which occurs by means of a tape which is held in a stationary manner relative to the cutting table by means of its strand running off the run-up surface during the relative movement of the raising device to the cutting table, so that no sliding movement occurs between the tape and the cutting which has merely been lifted off from the cutting table. The cutting can therefore be held pressed from below against the receiving surface of the receiving device with the help of the tape, with the support forming the receiving surface also being connected in a non-displaceable manner with the cutting table during the transfer of the cutting.

For holding the cutting in a clamped manner between the tape receiving the cutting and the receiving surface on the bottom side of the support, the tape can be provided with an air-permeable configuration so that when the bottom side of the support is subjected to a negative pressure the tape with the cutting is sucked against the receiving surface of the support and is held in a non-displaceable manner on the receiving surface. In the case of a different embodiment, the tape which can be placed with the help of the raising device against the bottom side of the support can consist of a ferromagnetic material, with the support being arranged on its bottom side in a magnetic way in order to attract this tape via a respective magnetic field towards the receiving surface on the bottom side of the support. For this purpose, the receiving surface could be provided with a magnetic lining. The cutting which is tightly held on the bottom side of the support can be conveyed with the support of the receiving device out of the region of the cutting table in order to be placed on a table again for further processing via the tape securing the contact on the support. Although tightly clamping the cutting on a receiving surface on the bottom side of the support is comparatively complex, it requires little space because the receiving device is held in a stationary manner above the cutting table during the transfer of the cutting.

If this spatial advantage is waived, the receiving device can form a rest for the cutting, which rest is provided adjacent to the run-up surface of the raising device and is connected in a non-displaceable manner with the raising device. The relative movement of the cutting relative to the receiving device can be compensated by a tape which is deflected about the end of the raising device which faces the cutting to be lifted, is guided along the rising run-up surface and is held in a stationary manner relative to the cutting table with its strand running off from the rising run-up surface. When the rest for the cutting which is connected with the raising device in a non-displaceable way comprises a support with a support surface for the cutting which is parallel to the table, the space required for such an apparatus increases at least by the length of this support surface in the direction of displacement of the raising device. The cutting which is lifted above the run-up surface of the raising device from the receiving table comes to lie on the support surface of the support however, which allows omitting further support measures for the cutting. The projection of the receiving device which is connected in a non-displaceable way with the raising device in the direction of displacement can be shortened when the rest for the cutting is composed of individual rest members which are guided along a guide means, with the guide means having a section parallel to the table and a section adjacent thereto which is guided back against the section parallel to the table, so that the projection is shortened by the guide section which is guided back.

In order to ensure a slide-free support of the cutting to be received via the tape which is displaceable relative to the run-up surface of the raising device, the tape needs to be movable at least in a length corresponding to the length of the cutting in the direction of displacement of the raising device. This path of the tape can be ensured in such a way that the tape receiving the cutting is guided in an endless manner about deflections. It is also possible however to wind off the tape receiving the cutting from a storage roll associated with the raising device and to hold the same in a stationary manner relative to the cutting table with its end running off from the run-up surface. There is no difference with respect to the movement of the strand of the tape receiving the cutting.

A further embodiment for the receiving device is to provide said receiving device with a wound roll for the cutting which is held in a frame associated with the raising device so as to be displaceable in respect of height and which rolls off with its roll on the cutting table. Due to the rolling-off motion of the roll received by the wound roll on the cutting table, the length of the wound-up cutting corresponds to the displacement length of the raising device, which represents a relevant precondition for tension-free and slippage-free receiving of the cutting on the wound roll. The height displacement of the wound roll is necessary for adjustment to the diameter of the roll. In order to maintain approximately the same feeding conditions of the cutting to the wound roll during the entire winding process, the guide means of the wound roll can extend transversally to the fed section of the cutting for the purpose of its height adjustment.

With the winding of the cutting on a wound roll it is not necessary to omit the friction-free receiving of the cutting by a tape extending along the run-up surface of the raising device. Generally, the cutting is not supplied together with the tape to the wound roll. For this reason, the raising device can comprise a storage roll for a tape which is deflected about the end of the raising device facing the cutting to be lifted, is guided along the rising run-up surface and is held in a stationary manner relative to the cutting table with its strand running off from the run-up surface and is deposited in front of the wound roll via a deflection device as a roll support for the wound roll on the cutting table. The covering of the cutting table with the remaining web remaining on the cutting table provides advantageous roll-off conditions for the wound cutting without having to fear any disadvantageous influence of the cutting by rolling off on the remaining web.

The lifting device for detecting the boundary section of the cutting can be arranged in different ways because it is especially relevant to lift off the boundary section for allowing the raising device to move beneath the same. The lifting of the boundary section by the lifting device entails the likelihood of a tensile load of the lifted boundary section as long as no length compensation of the lifted boundary section is provided, which causes a movement component of the gripped boundary section parallel to the cutting table. For this reason, the receiver of the lifting device may comprise a lifting path rising from the boundary section to be gripped towards the cutting, which allows for a simpler construction as compared with controlling the receiver of the lifting device in two axes. For length compensation it would also be possible to pivot the boundary section of the cutting to be lifted about a respective axis, e.g. with the help of a gripper roll.

In order to ensure that the fiber structure of the cutting is not subjected to any impairment by the receiver in the gripping area of the lifting device, the lifting device can comprise individually triggerable lifting units which comprise gripper elements which grip underneath the cutting from the side of the cutting gap and clamping bodies which cooperate with the gripper elements and clamp the boundary section of the cutting between themselves and the gripper elements, so that the boundary section of the cutting to be lifted is lifted by the gripper elements and is held by the clamping bodies in contact with the gripper elements without having to pierce the fiber structure. The gripper elements can be arranged in very different ways in order to be inserted through the cutting gap between the boundary section of the cutting to be gripped and the cutting table. For this purpose, the gripper elements could be arranged to be pivotable about an axis extending in the direction of the boundary section to be gripped. It would also be possible to widen the cutting gap by displacing the remainder of the web remaining on the cutting table in order to allow bent gripper fingers from sliding beneath the boundary section to be gripped. Especially advantageous constructional conditions are achieved in such a way that the gripper elements comprise gripper fingers which are displaceable along a connecting link and are flexible and ferromagnetic, and clamping bodies which are provided with magnets and which tightly hold the gripper fingers in their curvature for lifting off the boundary section from the cutting table, which gripper fingers are bent while sliding along the connecting link for gripping beneath the boundary section of the cutting.

BRIEF DESCRIPTION OF THE DRAWINGS

The subject matter of the invention is shown by way of example in the drawings, wherein.

DESCRIPTION OF THE PREFERRED EMBODIMENT

Figure 1:
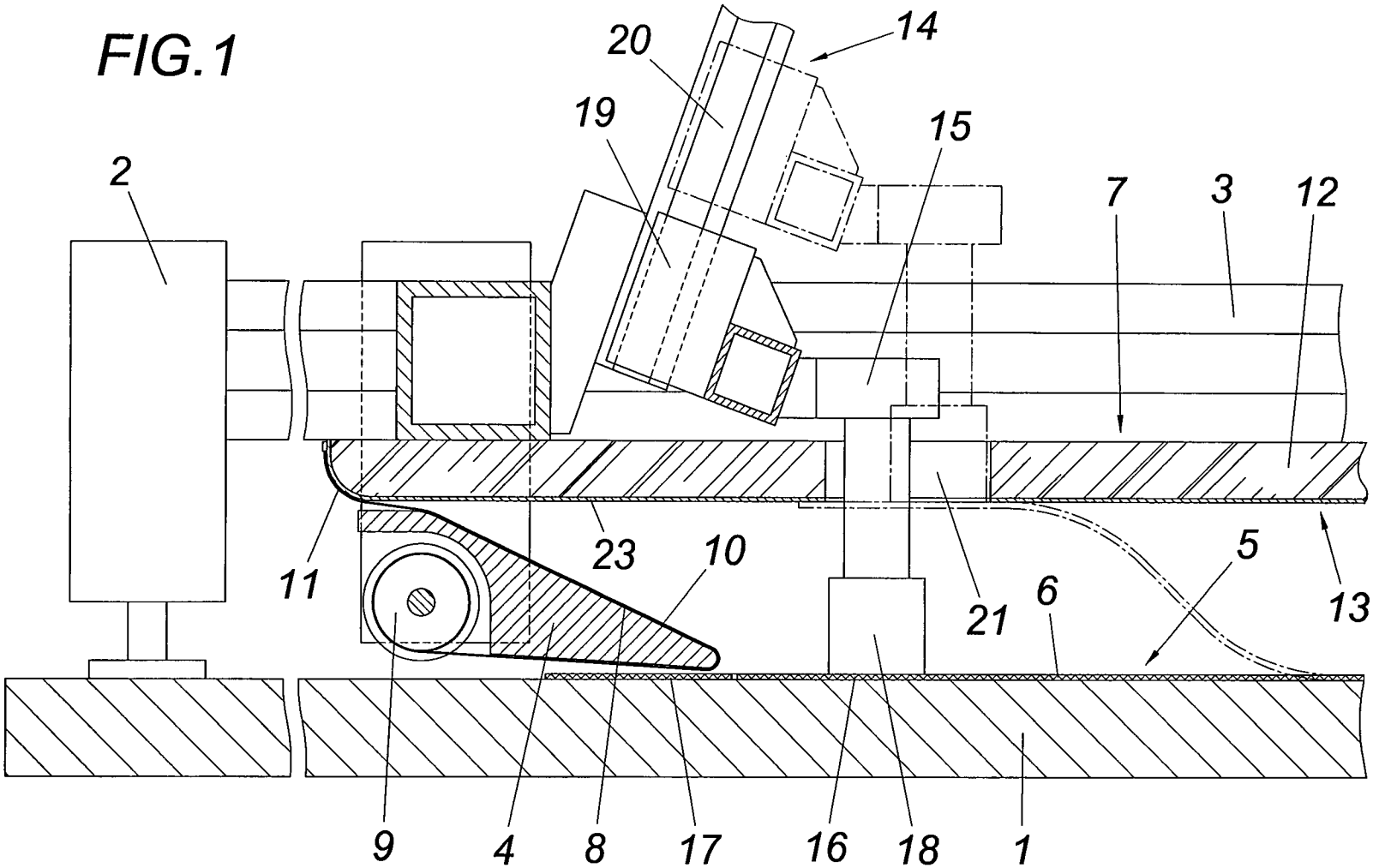
FIG. 1 shows an apparatus in accordance with the invention for detaching a workpiece from a cutting table in a schematic longitudinal sectional view.
Figure 2:
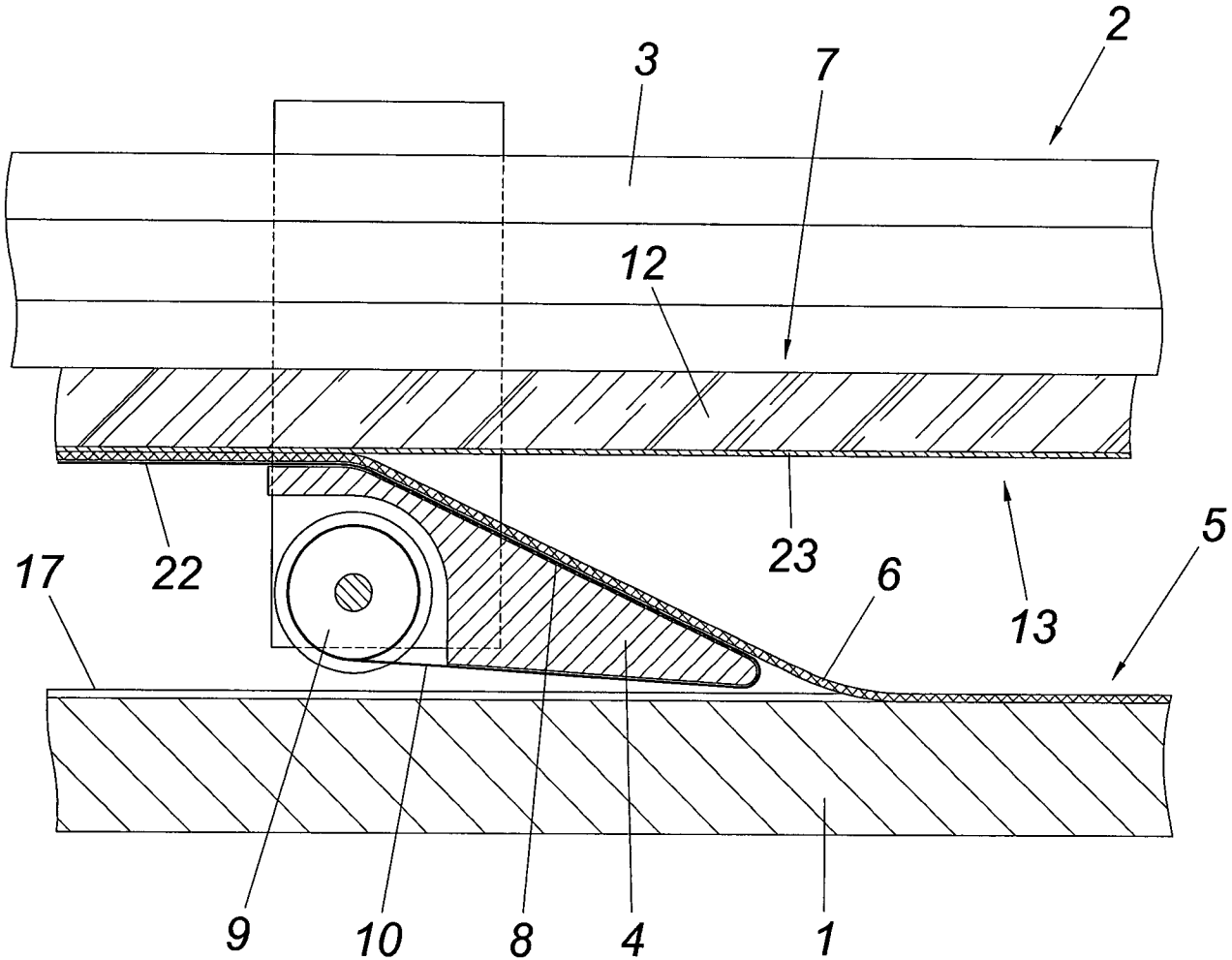
FIG. 2 shows the apparatus according to FIG. 1 in a working position which differs from the one of FIG. 1.

The apparatus for detaching a workpiece from a cutting table 1 according to FIGS. 1 and 2 comprises a frame 2 associated with the cutting table 1 with guide means 3 extending in the longitudinal direction of the cutting table 1 for displacing a raising device 4 for a cutting 6 cut from a web 5 and a receiving device 7 for the cutting 6 lifted off from the cutting table 1. The raising device 4 forms a run-up surface 8 rising from the cutting table 1 and carries a storage roll 9 for a tape 10 which is deflected about the end of the raising device 4 facing the cutting 6 to be lifted and is guided along the rising run-up surface 8. The end 11 of the tape 10 which runs off from the run-up surface 8 is anchored in a tight manner on the receiving device 7. The receiving device 7 comprises a plate-like support 12 which forms a receiving surface 13 for the cutting 6 on its bottom side. The arrangement is made in such a way that the run-up surface 8 of the raising device 4 extends under consideration of the thickness of tape 10 and the cutting 6 up to the receiving surface 13, so that during a relative displacement of the raising device 10 relative to the receiving device 7 the tape 10 unwound from the storage roll 9 is guided up to the bottom side of the support 12.

The receiving device 7 is associated with a lifting device 14 which is arranged at a distance above the cutting table 1 and comprises lifting units 15 which are distributed over the width of the cutting table, with the help of which the boundary section 16 of the cutting 6 which faces the raising device in its initial position according to FIG. 1 can be gripped and can be lifted from the cutting table 1, as is indicated with the dot-dash line. Since merely the cutting 6 but not the remainder 17 of the web 5 remaining on the cutting table 1 is to be lifted by the lifting units 15, the individual lifting units must each be triggered according to the progression of the boundary section 16 in such a way that merely the boundary section 16 of the cutting 6 is gripped, which means that the receiver of the lifting device 14 formed by the lifting units 15 is adjusted to the respective length of the boundary section 16 to be gripped. For this purpose, either each lifting unit 15 can be provided with a separate lifting drive or an individually triggerable receiving head 18 for the boundary section 16 of the cutting 6, so that the lifting device 14 can have a common lifting drive 19, as is shown in FIG. 1.

When lifting the boundary section 16 of the cutting 6 which is gripped by the receiving heads 18 of the selected lifting units 15, a length compensation must be provided for the lifted boundary section 16 in order to avoid exerting any tensile stresses from the lifting device 14 on the cutting 6. The movement component required for this purpose in the travelling direction of the raising device 4 is ensured by a lifting path ascending from the boundary section 16 of the cutting towards the cutting 6, which lifting path is forced by a respective inclination of the guide means 20 for the lifting drive 19. The lifting units 15 therefore must penetrate the support 12 of the receiving device 7 in respective oblong holes 21.

The raising device 4 can move beneath the boundary section 16 of cutting 6 which is lifted to the dot-dash position according to FIG. 1, with the cutting 6, adjacent to the lifted boundary section 16, resting against the tape which is drawn over the run-up surface 8 and is unwound from the storage roll 9. Since the receiving device 7 is held in a stationary manner relative to the cutting table 1 during the transfer of the cutting, e.g. by means of a lock of its support 12 adjustable along the frame guide means 3 on said guide means 3, and the end 11 of the tape 10 is connected with the support 12 in a tension-proof manner, the tape 10 moves in a slip-free manner relative to the cutting 6 along the run-up surface 8 of the raising device 4, so that the cutting 6 which is progressively lifted along the run-up surface 8 is placed progressively against the receiving surface 13 on the bottom side of the support 12 by means of the strand 22 of tape 10 which runs off from the run-up surface 8 and is held in a non-displaceable manner relative to the receiving device 7. In order to fix the cutting 6 against the receiving surface 13, the tape 10 must be pressed from below against the support 12. For this purpose, the support 12 comprises on its bottom side a magnetic rest 23 which forms the receiving surface 13 and with the help of which the tape 10 which is made of a ferromagnetic material is attracted to the bottom side of the support 12 under clamping pressuring of the cutting 6 which is disposed between the tape 10 and the magnetic rest 23. The cutting 6 which is lifted off in this manner from the cutting table 1 can then be conveyed with the receiving device 7 along the guide means 3 from the region of the cutting table 1 without having to fear any drawing of the cutting 6.

Figure 3:
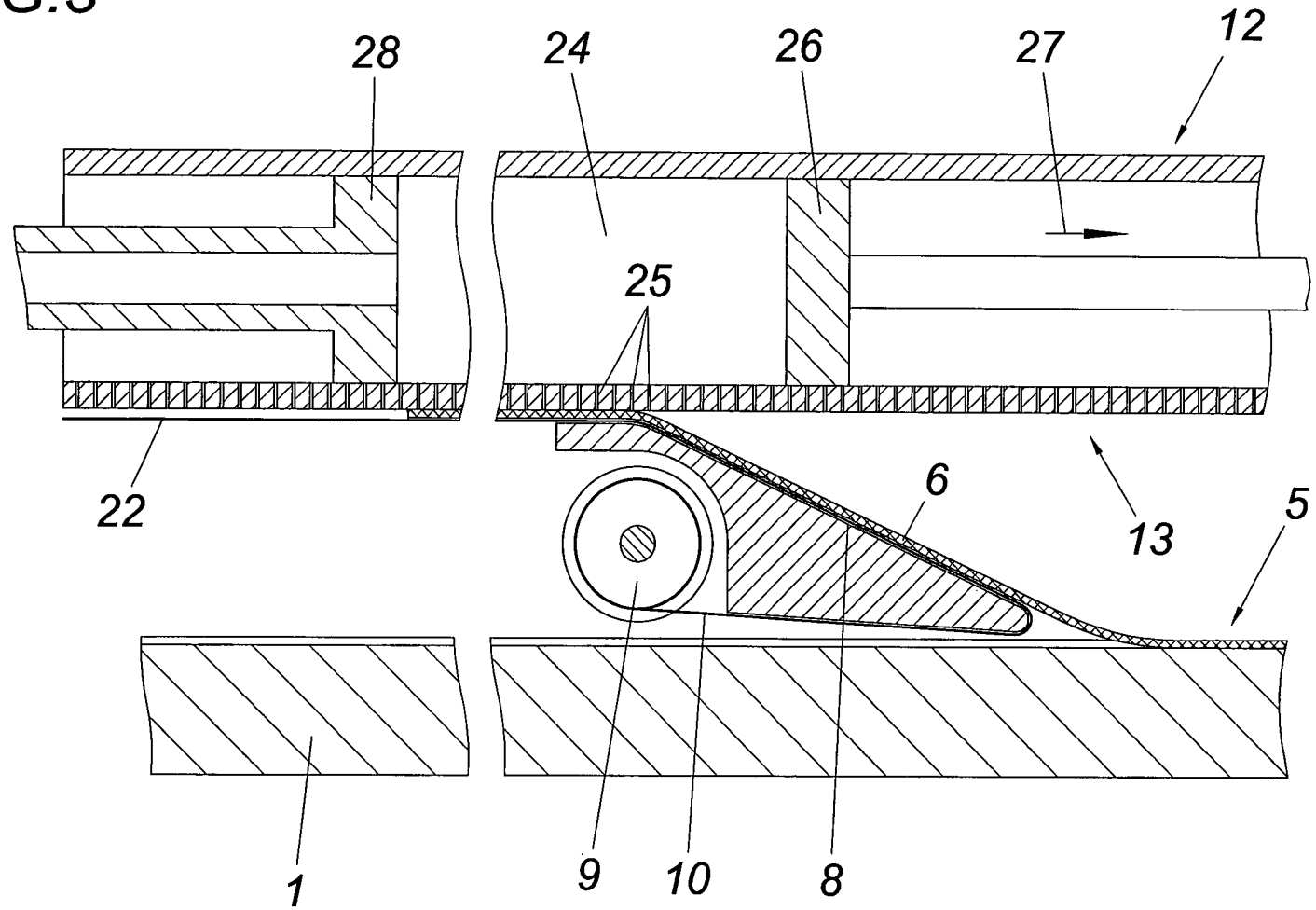
FIG. 3 shows a receiving device forming a suction box for the lifted cutting in a schematic longitudinal sectional view.

Another possibility to tightly clamp the cutting 6 between the tape 10 and the receiving surface 13 on the bottom side of the support 12 is to suck up the air-tight tape 10 against the bottom side of the support 12 which needs to be provided for this purpose with a respective negative pressure. Especially advantageous constructional conditions are obtained in this connection according to FIG. 3 in such a way that the support 12 is arranged as a suction box 24 which is provided with lead-through openings 25 to the receiving surface 13 for the cutting 6 and is sealed at least on the face side opposite of the raising device 4 with a piston 26 which is displaced with the raising device 4 in order to extend the suction zone of the suction box 24 to the extent of progressive lifting of cutting 6, as is indicated by arrow 27 in FIG. 3. If the face side of the suction box 24 which is opposite of the piston 26 is also formed by a piston 28, the suction zone can additionally be adjusted to the position of the respective cutting 6 on the cutting table 1. In the arrangement of two pistons 26 and 28, providing the suction box 24 with negative pressure advantageously occurs by the piston rod of at least one of the pistons 26, 28, and in the embodiment by the piston rod of piston 28.

Figure 4:
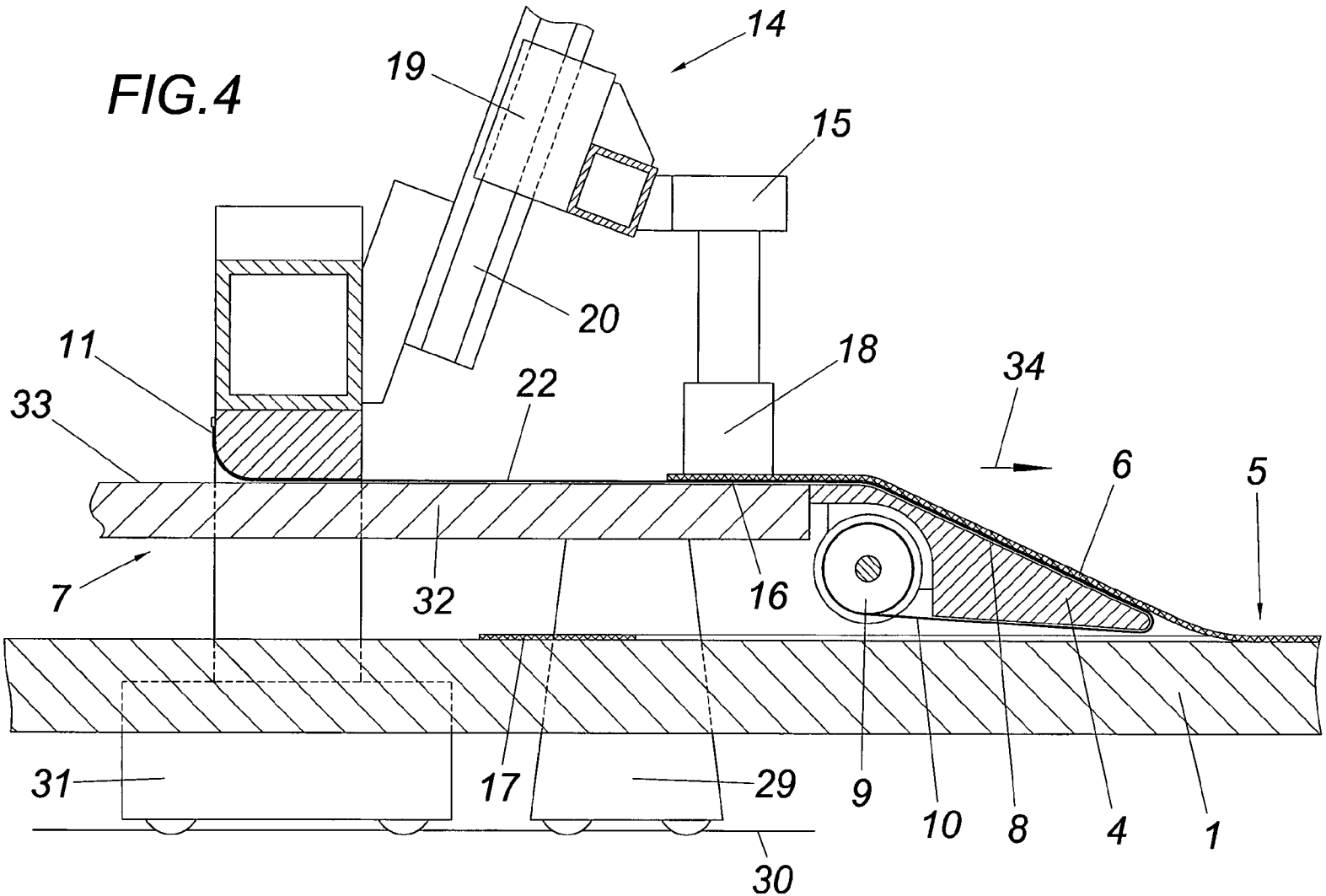
FIG. 4 shows an illustration corresponding to FIG. 1 of a constructional variant of an apparatus in accordance with the invention.

The apparatus according to FIG. 4 differs from the one according to FIGS. 1 and 2 especially by the arrangement of the receiving device 7, because said receiving device 7 represents in combination with the raising device 4 a common driving unit 29 which is displaceable against the cutting table 1 on a guide means 30. The lifting device 14 with the lifting units 15 distributed over the working width of the cutting table 6 is arranged in this embodiment on a separate carriage 31 which is also displaceable along the guide means 30 and which is held in a stationary manner against the cutting table 1 by the receiving device 7 during the transfer of the cutting, preferably by a lock on the guide means 30. The tape 10 which is unwound from the storage roll 9 and is guided over the run-up surface 8 is anchored in a tension-proof manner on the carriage 31, which occurs above the receiving device 7 which forms a plate-like support 32 with a rest 33 parallel to the table for the cutting 6. When the driving unit 29 is displaced in the direction of feed 34 relative to the cutting table 1, the raising device 4 moves beneath the boundary section 16 of cutting 6 which has been lifted by the lifting device 14, which cutting is thus lifted along the run-up surface 8 onto support 32 and is placed on its rest 33 by interposing the tape 10. Since the strand 22 of the tape which runs off from the raising device 4 is held in a stationary manner relative to the cutting table 1, cutting 6 is deposited without any relative movements against tape 10 on the rest 33 of the receiving device 7, whereupon it is conveyed out of the region of the cutting table 1 with the help of carriage 31 after being completely deposited.

Figure 5:
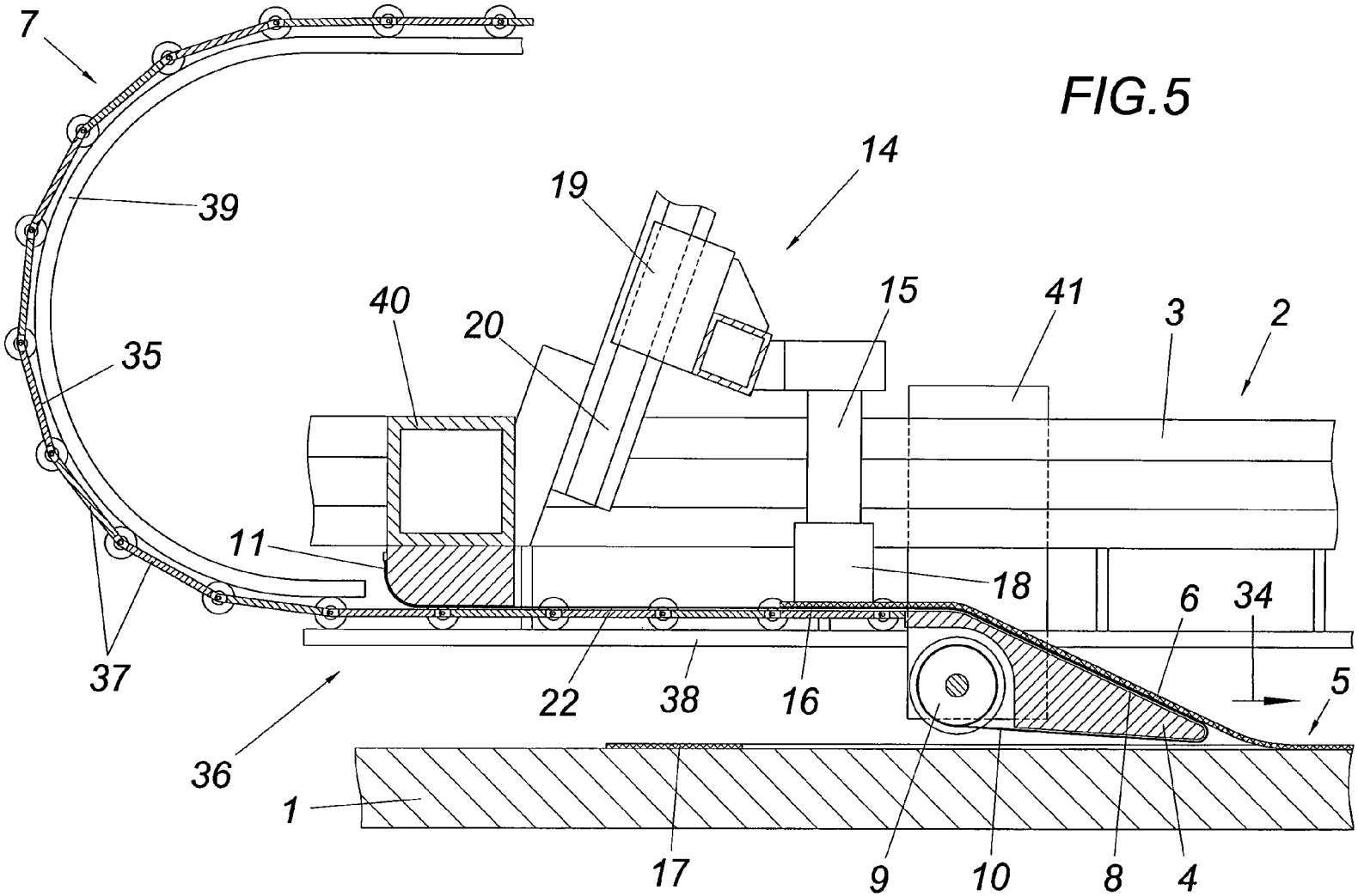
FIG. 5 shows a further constructional variant of an apparatus in accordance with the invention in a schematic longitudinal sectional view.

The plate-like support 32 requires a minimum length for receiving the cutting 6, which minimum length corresponds to the length of the cutting in the direction of feed 34, which leads to a considerable need for space in the case of long workpieces. In order to limit this need for space, the receiving device 7 can comprise a rest 35 for the cutting 6 according to FIG. 5 which is made of individual concatenated support members 37 which are guided along a guide means 36, with the guide means 36 having a section 38 parallel to the table and an adjacent section 39 guided back to the section 38 parallel to the table. The rest 35 formed by the support members 37 in the region of the guide section 38 parallel to the table receives the cutting 6 in the manner as explained in connection with FIG. 4 because the tape 10 is held tightly against the table again, which occurs on a support 40 for the lifting device 14, which support is displaceable along the frame guide means 3. Said support 40 must be locked in a non-displaceable way against the guide means 3 for transferring the cutting 6 to the receiving device 7. When the cutting 6 which is received by the receiving device 7 is conveyed out of the region of the table, such that the raising device 4 is displaced together with the receiving device 7 along the guide means 3 by means of the carriage 41, it is either necessary to co-displace the support 40 or detach the tape 10 from the support 40.

Figure 6:
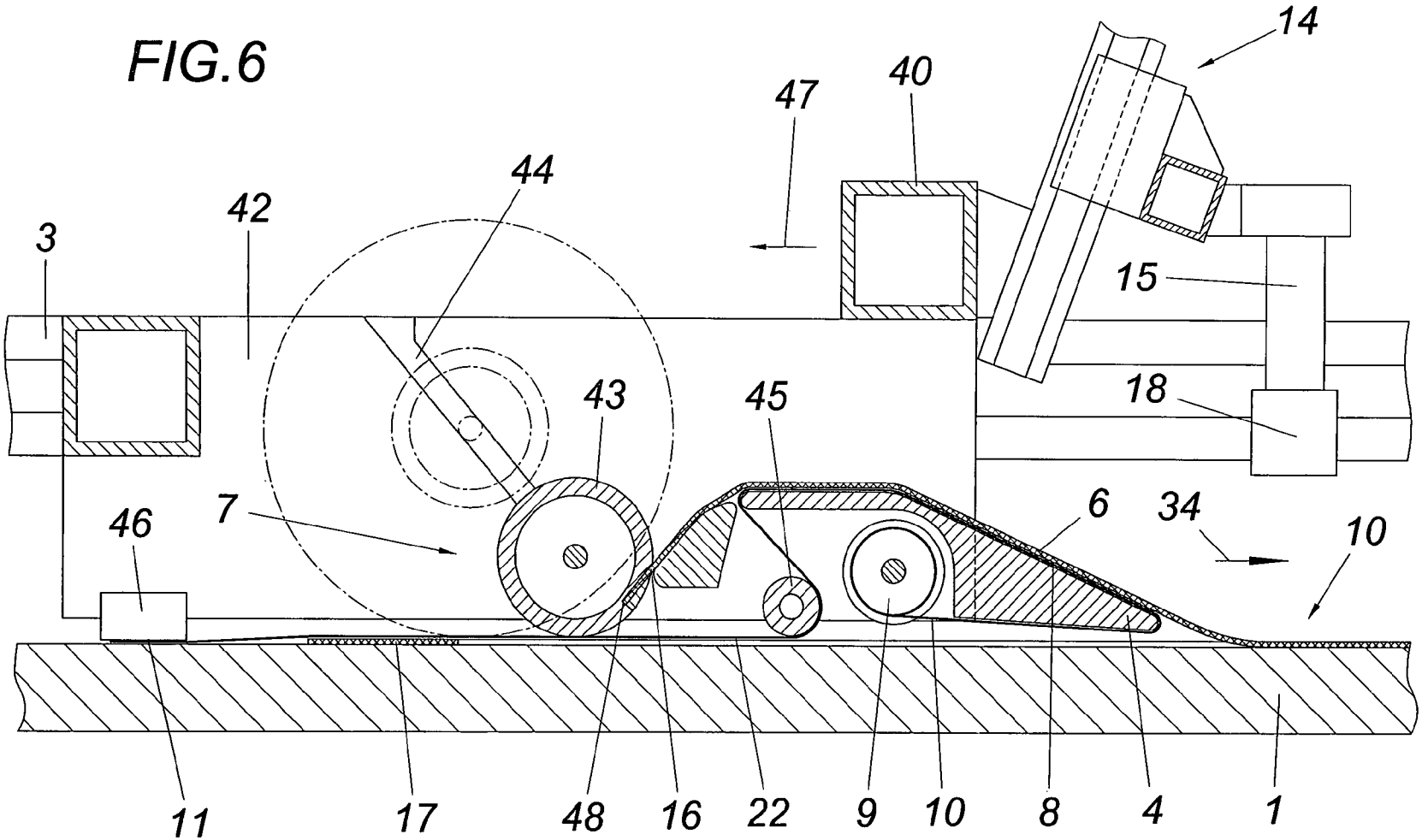
FIG. 6 shows an apparatus in accordance with the invention with a receiving device arranged as a wound roll in a schematic longitudinal sectional view.

FIG. 6 shows a further possibility of arranging the receiving device 7 which comprises a wound roll 43 which is rotatably held in a carriage 42. The wound roll 43 rests on the cutting table 1 and is held in a guide means 44 to be displaceable according to height in order to take into account the increase in diameter during the winding up of the cutting 6. Carriage 42, which is displaceable along a frame guide means 3, carries the raising device 4, which on its part is provided with a storage roll 9 for a tape 10 guided along the run-up surface 8. The strand 22 of the tape which runs off from the raising device 4 is not wound up with the cutting 6 on the wound roll 43, but is supplied via a deflection device 45 to the cutting table 1 in order to be placed on the remaining web 17 remaining on the cutting table 1 as an unwinding web for the wound roll 43 or the roll received by the wound roll 43. The strand 22 of the tape which runs off from the raising device 4 is thus held again in a stationary manner against the cutting table 1, so that there are no frictional forces between the cutting 6 and the tape 10 for the guidance of the cutting 6 to be wound up. The end 11 of the tape 10 on the run-off side can be clamped with the help of a clamp 46 on the cutting table 1.

According to FIG. 6, the lifting device 14 is associated with the carriage 42. The support 40 receiving the lifting device 14 must be held in a displaceable manner on the carriage 42 as is indicated by the arrow 47, so that the boundary section 16 of the cutting 6 which is lifted with the help of the lifting units 15 can be supplied to the wound roll 43. The boundary section 16 of cutting 6 which is lifted by the lifting device 14 must be inserted in a respective receptacle 48 of the wound roll 43, so that during a feeding movement of the carriage 42 the cutting 6 which is lifted from the cutting table 1 by a raising device 4 can be wound up on the tape 10 in a tension-free manner by automatic unwinding of the wound roll 43 with the already wound section of cutting 6.

Figure 8:
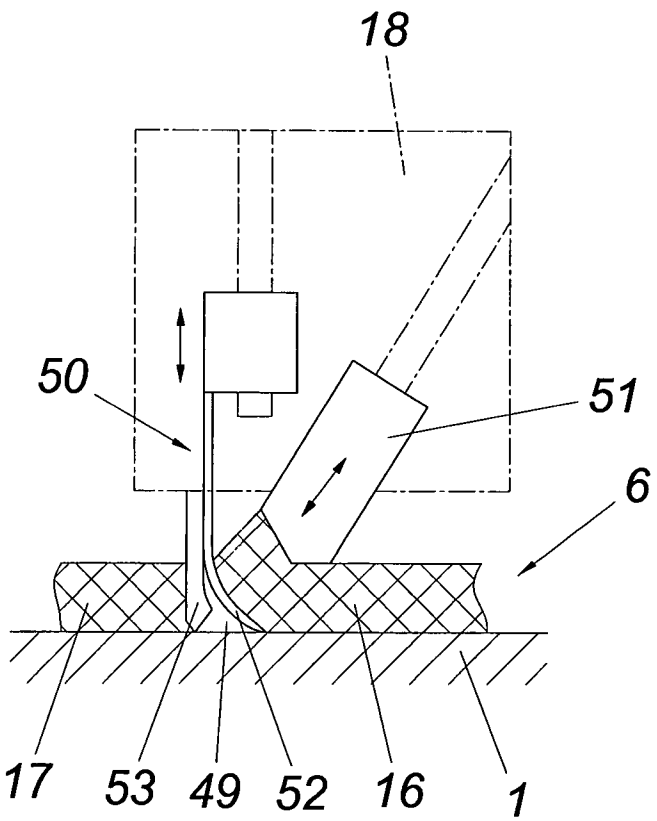
FIGS. 7 and 8 show a lifting unit of a lifting device for lifting off the boundary section of the cutting to be gripped from the cutting table in different working positions in a schematic side view.
Figure 7:
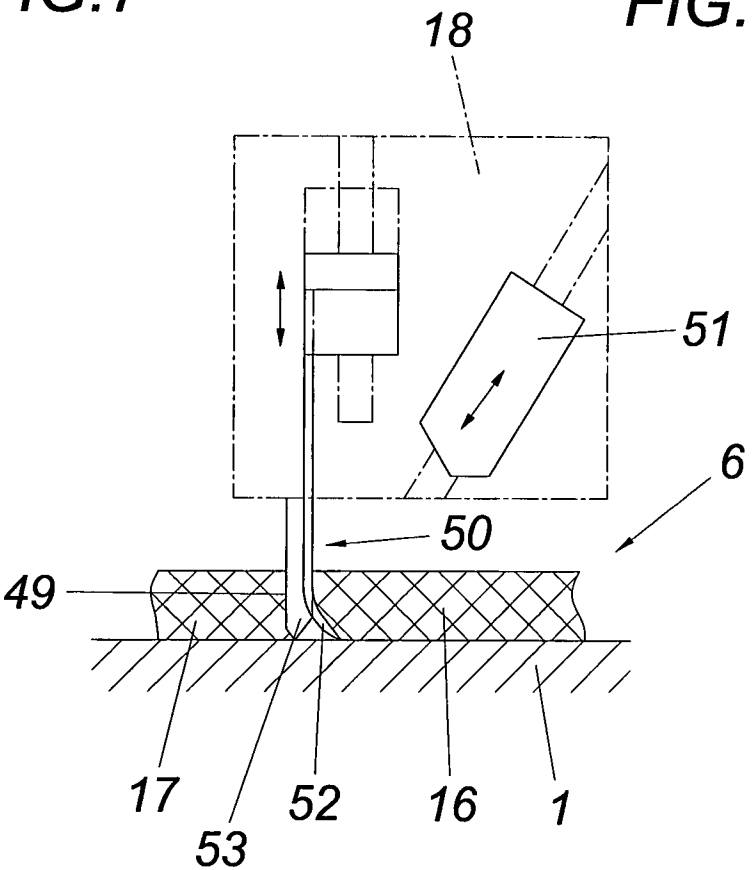

The receiving head 18 of the lifting units 15 can be arranged in different ways. It is merely relevant to lift the boundary section 16 of the cutting 6 in a careful way, so as to enable the raising device 4 to move beneath the lifted boundary section 16. Depending on the nature of the web 10, known receiving heads 18 can be used which grip the boundary section 16 with the help of negative pressure, gluing, freezing or the like. In many cases however mechanical gripping devices are preferable. Notice must be taken that the boundary section 16 to be gripped must be treated with utmost care. In order to enable the boundary section 16 of the cutting 6 to be gripped mechanically, the receiving head 18 is provided according to FIGS. 7 and 8 with gripper elements 50 which grip beneath the boundary section 16 from the side of the cutting gap 49 and with clamping bodies 51 which cooperate with the gripper elements 50 and which tightly clamp the boundary section 16 of the cutting 6 between themselves and the gripper elements 50. The gripper elements 50 are arranged according to FIGS. 7 and 8 as flexible ferromagnetic gripper fingers 52 which are displaced along a connecting link 53 and are deflected against the bottom side of the boundary section 16 to be gripped. The gripper fingers 52 are tightly held in their curvature or bent in addition with the help of the magnetic clamping bodies 51 which are applied to the boundary section 16 in order to lift the boundary section 16 of cutting 6 over the receiving head 18 of the lifting units 15, which boundary section is tightly clamped between the gripper fingers 52 and the clamping bodies 51.

Figure 10:
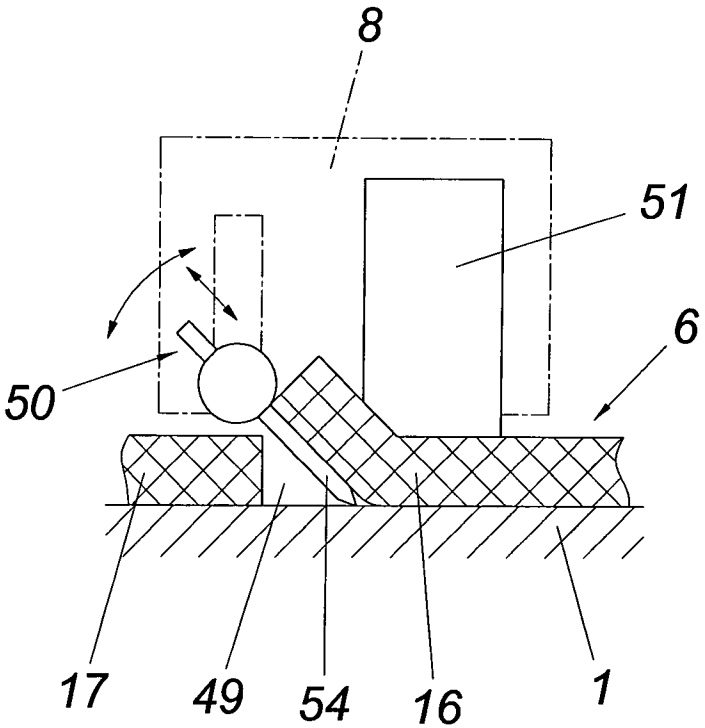
FIGS. 9 and 10 show a constructional variant of a lifting unit for gripping the boundary section of the cutting to be lifted in two working positions.
Figure 9:
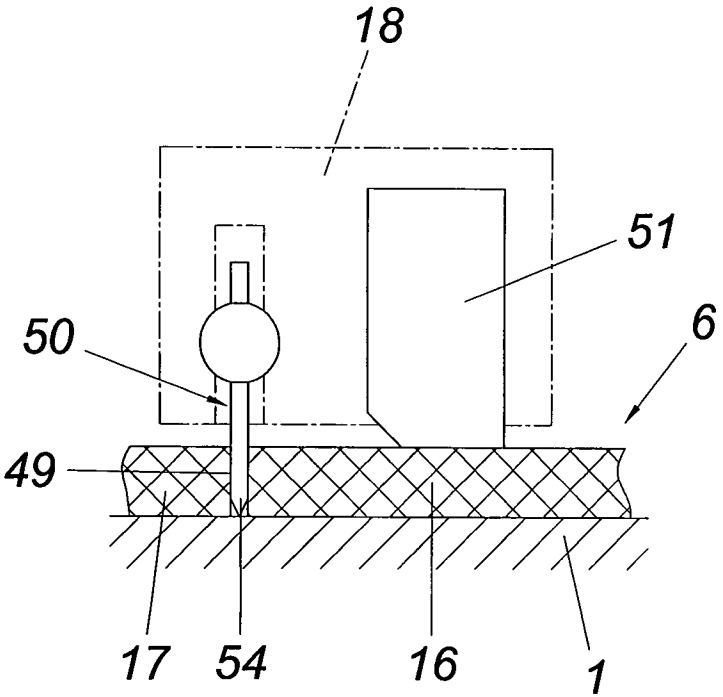
Figure 11:
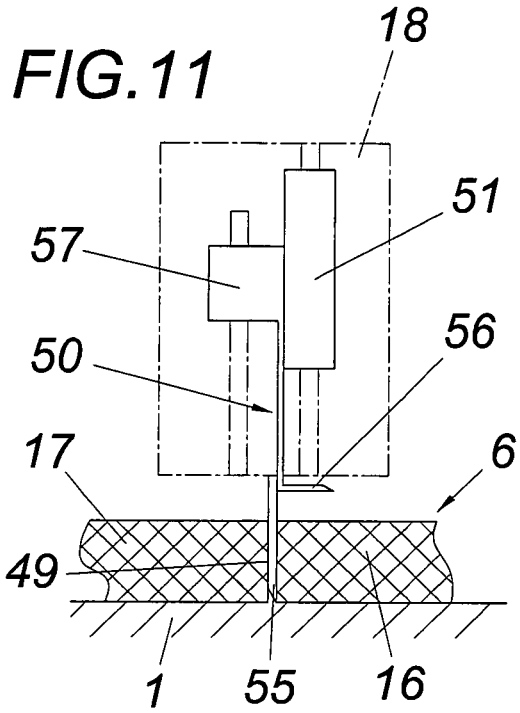
FIGS. 11 to 14 show an additional embodiment of a lifting unit in different working positions.

Although the receiving head 18 according to FIGS. 9 and 10 also comprises gripper elements 50 which cooperate with clamping bodies 51, these gripper elements 50 form inflexible gripper fingers 54 which can not only be adjusted according to height, but also be pivoted in addition, in order to grip beneath the boundary section 16 of the cutting 6. The clamping bodies 51 represent a counter-support on which the boundary section 16 which is lifted by the gripper fingers 54 is pressed against the clamping bodies 51 in order to enable lifting off the boundary section 16 completely from the cutting table 1 during the lifting of the receiving head 18.

Figure 12:
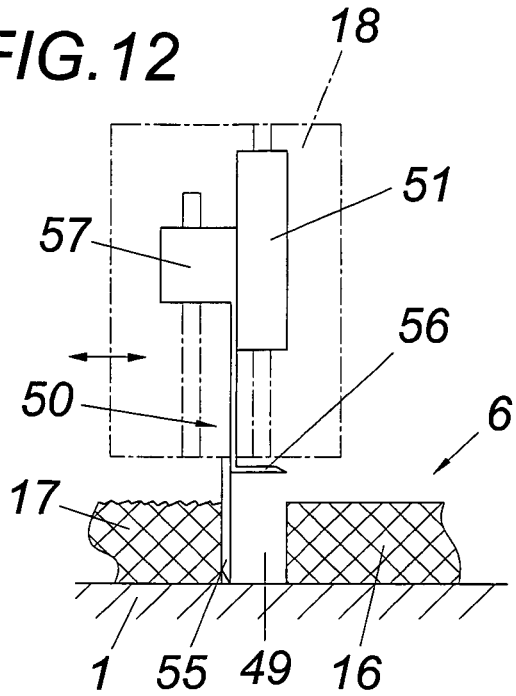
Figure 13:
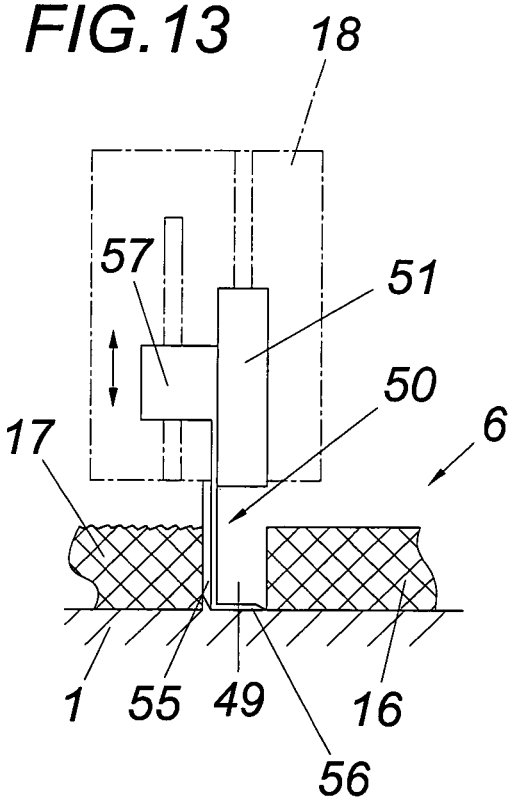
Figure 14:
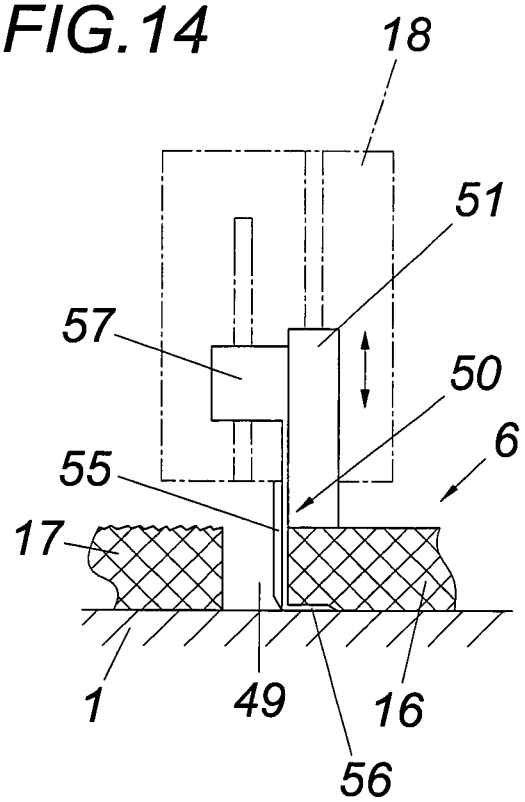

FIGS. 11 to 14 show a further receiving head 18, in which the cutting gap 49 is widened at first, such that the remainder 17 of the web is moved away with the help of needles 55 engaging in the cutting gap 49 from the boundary section 16 of the cutting 6 by means of a displacement of the receiving head 18 transversally to the cutting gap 49, as is shown in FIG. 12. By moving the remainder of web 17 remaining on the cutting table 1 away from cutting 6, space is provided for the bent gripper fingers 56 which are moved with the help of actuator 57 towards the cutting table 1 and are subsequently slid beneath the boundary section 16 by a displacement of the receiving head 18 towards the boundary section 16 of cutting 6. After the application of the clamping bodies 51 (FIG. 14), the boundary section 16 of cutting 6 which is tightly held between the bent gripper fingers 56 and the clamping bodies 51 of the lifting units 15 can be lifted off from the cutting table 1.

It is understood that the invention is not limited to the illustrated embodiments. The run-up surface 8 of the raising device 5 could also be formed by a roll or bar through which the cutting 6 is lifted and supplied progressively to the receiving device 7. In order to adjust the receiver of the lifting device 14 to the respective length of the boundary section 16 of the cutting 6, the lifting device 14 need not be subdivided into individual lifting units 15 which can be individually triggered. The receiver of the lifting device 14 could also be arranged in the form of a suction box extending at least over a region of the working width of the cutting table 1, which suction box is provided with pistons adjustable in the direction of the working width of the cutting table 1 which delimit the suction volume of the of the suction box, so that the pistons can be used to adjust the position and the length of the suction zone of the suction box to the respective position and length of the boundary section 16 of the cutting 6 to be gripped. The suction box for receiving the lifting device 15 in such a way can therefore be arranged similar to the suction box shown in FIG. 3 for sucking up the cutting 6.

The invention claimed is:

1. An apparatus for detaching a workpiece from a cutting table, which workpiece comprises a cutting cut out from a flexible web made of fiber material, the apparatus comprising:

a raising device which is displaceable relative to the cutting table receiving the web with the cutting and which comprises a run-up surface for the workpiece ascending from the cutting table for progressively lifting the workpiece from the cutting table, a receiving device progressively receiving the workpiece after the run-up surface, and a lifting device for the edge of the workpiece facing the raising device, the lifting device being provided at a distance above the cutting table, comprising a receiver which can be adjusted to the length of the boundary section of the cutting facing the raising device, the lifting device lifting the workpiece off of the cutting table and holding the received boundary section in a transfer position lifted off from the cutting table, wherein the raising device is displaceable between the lifting device and the web resting on the cutting table, and wherein the raising device and the lifting device are oriented such that the raising device is movable to be between the lifting device and the flexible web lying on the cutting table and to be underneath the received boundary section of the cutting in the transfer position lifted off from the cutting table by the lifting device.

2. An apparatus according to claim 1, wherein the receiving device forms a support which is stationary during the transfer of the cutting relative to the cutting table and comprises a receiving surface for the cutting parallel to the table on the bottom side facing the cutting table, wherein the raising device comprises a tape which is deflected about the end of the raising device facing the cutting to be lifted and is guided along the run-up surface rising up to the receiving surface on the bottom side of the support, wherein said tape has a strand running off of the run-up surface, and wherein after the strand runs off of the run-up surface, the strand is held in a stationary manner relative to the support and clamps the cutting to the receiving surface of the support.

3. An apparatus according to claim 2, wherein the tape which can be applied with the help of the raising device to the bottom side of the support is arranged in an air-tight manner and the support comprises a device for applying a negative pressure to its bottoms side.

4. An apparatus according to claim 2, wherein the tape which can be applied with the help of the raising device to the bottom side of the support consists of a ferromagnetic material and the support is arranged magnetically on its bottom side.

5. An apparatus according to claim 1, wherein the receiving device forms a rest for the cutting, which rest is provided adjacent to the run-up surface of the raising device and is connected in a non-displaceable manner with the raising device, and the raising device comprises a tape which is deflected about the end of the raising device facing the cutting to be lifted, is guided along the ascending run-up surface and is held with its strand running off from the run-up surface in a stationary manner against the cutting table.

6. An apparatus according to claim 5, wherein the rest for the cutting comprises a support with a support surface for cutting parallel to the table.

7. An apparatus according to claim 5, wherein the rest for the cutting is composed of individual support members guided along a guide means, with the guide means having a section which is parallel to the table and a section which is adjacent thereto and is guided back to the section parallel to the table.

8. An apparatus according to claim 2, wherein the tape receiving the cutting is guided in an endless manner about deflections.

9. An apparatus according to claim 2, wherein the tape can be wound off from a storage roll associated with the raising device, and wherein the strand of said tape comprises an end of said tape.

10. An apparatus according to claim 1, wherein the receiving device comprises a wound roll for the cutting, which roll is held in a height-adjustable manner in a frame associated with the raising device and rolls off with its roll on the cutting table.

11. An apparatus according to claim 10, wherein the guide means of the wound roll extends transversally to the incoming section of the cutting.

12. An apparatus according to claim 10, wherein the raising device comprises a storage roll for a tape which is deflected about the end of the raising device facing the cutting to be lifted, is guided along the ascending run-up surface and is held in a stationary manner relative to the cutting table with its strand running off from the run-up surface and is deposited in front of the wound roll via a deflection device as a roll support for the wound roll on the cutting table.

13. An apparatus according to claim 1, wherein the lifting device comprises a lifting path for the receiver of the lifting device, and wherein the receiver moves along the lifting path when the lifting device lifts the boundary section.

14. An apparatus according to claim 1, wherein the receiver of the lifting device comprises individually triggerable lifting units which comprise gripper elements which grip underneath the cutting from the side of a cutting gap and clamping bodies which cooperate with the gripper elements and clamp the boundary section of the cutting between themselves and the gripper elements.

15. An apparatus according to claim 14, wherein the gripper elements comprise gripper fingers which are displaceable along a connecting link and are flexible and ferromagnetic, and wherein the clamping bodies are provided with magnets.

* * * * *